US007736243B2

(12) United States Patent
Sanchez et al.

(10) Patent No.: US 7,736,243 B2
(45) Date of Patent: Jun. 15, 2010

(54) GOLF CLUB ATTACHMENT MECHANISMS AND METHODS TO ATTACH GOLF CLUBS

(75) Inventors: Richard R. Sanchez, New River, AZ (US); Mitchell E. Bac, Glendale, AZ (US); Bradley D. Schweigert, Anthem, AZ (US); Eric V. Cole, Phoenix, AZ (US)

(73) Assignee: Karsten Manufacturing Coporation, Phoenix, AZ (US)

( * ) Notice: Subject to any disclaimer, the term of this patent is extended or adjusted under 35 U.S.C. 154(b) by 1 day.

(21) Appl. No.: 12/031,633

(22) Filed: Feb. 14, 2008

(65) Prior Publication Data

US 2009/0181791 A1 Jul. 16, 2009

Related U.S. Application Data

(60) Provisional application No. 61/020,945, filed on Jan. 14, 2008.

(51) Int. Cl.
*A63B 53/02* (2006.01)

(52) U.S. Cl. ..... 473/288; 473/307; 473/309

(58) Field of Classification Search ..... 473/288, 473/298–299, 307–310, 315, 305
See application file for complete search history.

(56) References Cited

U.S. PATENT DOCUMENTS

| | | | | |
|---|---|---|---|---|
| 1,380,554 | A * | 6/1921 | Hawkesworth | 403/354 |
| 1,550,647 | A * | 8/1925 | Mattern | 473/310 |
| 1,895,417 | A | 1/1933 | Lard | |
| 1,906,239 | A | 5/1933 | Reach | |
| 1,930,204 | A | 10/1933 | Judd et al. | |
| 1,982,087 | A | 11/1934 | Wantz | |
| 2,027,452 | A | 1/1936 | Rusing | |
| 2,146,048 | A | 2/1939 | Barnhart | |
| 4,715,474 | A * | 12/1987 | Wehmeyer | 182/194 |
| 4,808,127 | A * | 2/1989 | Swanic | 439/139 |
| 4,852,782 | A * | 8/1989 | Wu et al. | 224/661 |
| 4,943,059 | A * | 7/1990 | Morell | 473/306 |
| 5,385,346 | A | 1/1995 | Carroll et al. | |
| 5,496,029 | A | 3/1996 | Heath et al. | |
| 5,716,289 | A * | 2/1998 | Okoneski | 473/297 |
| 5,863,260 | A | 1/1999 | Butler, Jr. et al. | |
| 5,951,411 | A * | 9/1999 | Wood et al. | 473/307 |
| 6,039,659 | A | 3/2000 | Hamm | |
| 6,238,303 | B1 * | 5/2001 | Fite | 473/342 |
| RE38,605 | E * | 9/2004 | Kubica et al. | 473/314 |
| 6,875,114 | B2 * | 4/2005 | Barron et al. | 464/179 |
| 7,017,252 | B2 | 3/2006 | Lenhof et al. | |

(Continued)

FOREIGN PATENT DOCUMENTS

| | | |
|---|---|---|
| CA | 2421127 | 9/2004 |

(Continued)

*Primary Examiner*—Stephen L. Blau

(57) ABSTRACT

In one embodiment, a golf club attachment mechanism comprises a hosel adapter with a first slot coupler across a top portion of the hosel adapter, and a shaft adapter with a second slot coupler across a bottom portion of the shaft adapter. The second slot coupler of the shaft adapter is complementary to the first slot coupler of the hosel adapter. The first slot coupler and the second slot coupler couple together to restrict a rotational movement of the hosel adapter relative to the shaft adapter. Other embodiments are disclosed herein.

27 Claims, 13 Drawing Sheets

U.S. PATENT DOCUMENTS

| | | | | |
|---|---|---|---|---|
| 7,083,529 | B2 | 8/2006 | Cackett et al. | |
| 7,207,897 | B2 * | 4/2007 | Burch et al. | 473/288 |
| 7,226,364 | B2 * | 6/2007 | Helmstetter | 473/307 |
| 2001/0011042 | A1 | 8/2001 | Roark | |
| 2004/0018886 | A1 | 1/2004 | Burrows | |
| 2004/0018887 | A1 * | 1/2004 | Burrows | 473/307 |
| 2004/0102256 | A1 * | 5/2004 | Kumamoto | 473/319 |
| 2005/0124432 | A1 * | 6/2005 | Huang et al. | 473/305 |
| 2005/0176521 | A1 | 8/2005 | Burch et al. | |
| 2006/0264266 | A1 | 11/2006 | Jung | |
| 2006/0281575 | A1 * | 12/2006 | Hocknell et al. | 473/306 |
| 2007/0004527 | A1 * | 1/2007 | Helmstetter | 473/282 |
| 2007/0078026 | A1 | 4/2007 | Holt et al. | |
| 2007/0265106 | A1 * | 11/2007 | Burrows | 473/307 |
| 2008/0254908 | A1 * | 10/2008 | Bennett et al. | 473/288 |
| 2009/0011848 | A1 * | 1/2009 | Thomas et al. | 473/288 |

FOREIGN PATENT DOCUMENTS

| | | |
|---|---|---|
| GB | 879553 | 10/1961 |
| GB | 899562 | 6/1962 |
| GB | 2109249 | 6/1983 |
| JP | 2000157650 | 6/2000 |
| WO | WO 97/45172 | 12/1997 |
| WO | WO 2004/009186 | 1/2004 |

* cited by examiner

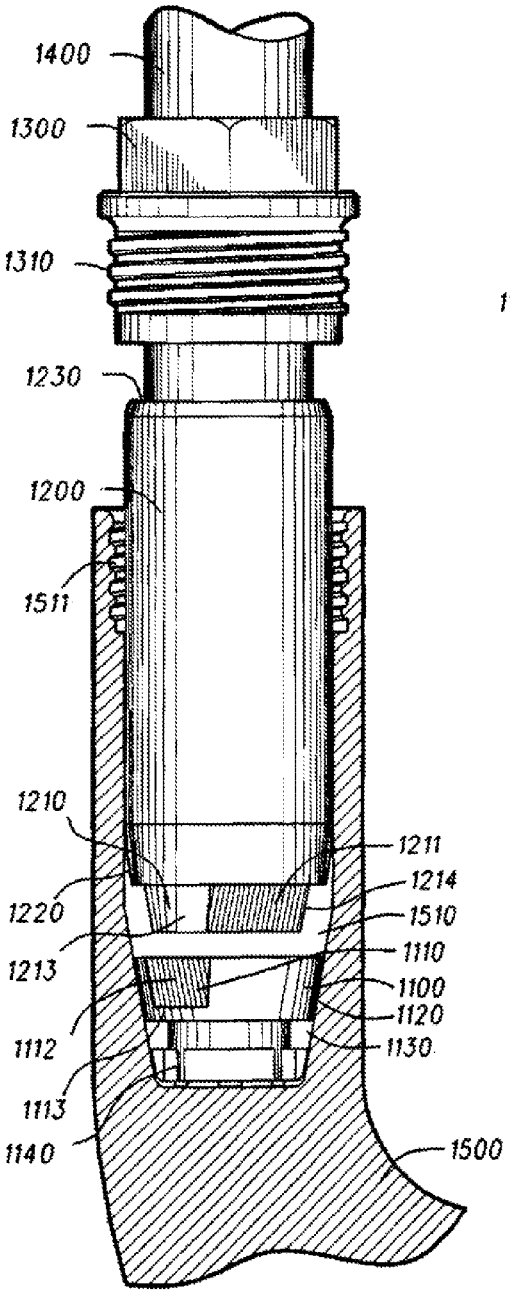
1000 Fig. 1
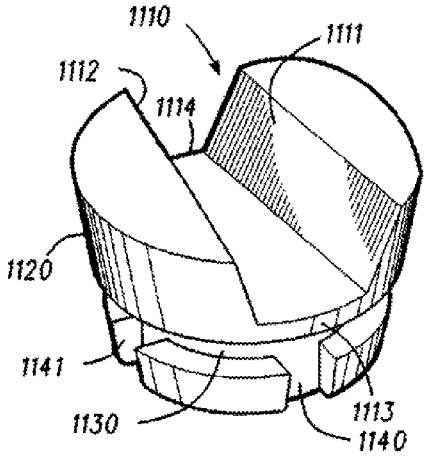
1100
Fig. 2
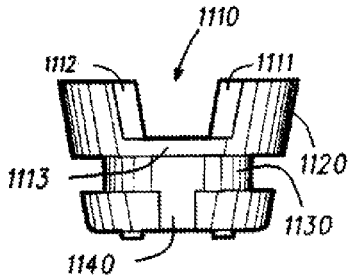
1100
Fig. 3

14200

14200

14200

14000

GOLF CLUB ATTACHMENT MECHANISMS AND METHODS TO ATTACH GOLF CLUBS

CROSS REFERENCE TO RELATED APPLICATIONS

This application is claims priority from: U.S. Provisional Patent Application No. 61/020945, filed Jan. 14, 2008, titled Golf Club Attachment Mechanism.

TECHNICAL FIELD

This disclosure relates generally to golf equipment, and relates more particularly to golf club attachment mechanisms and methods of manufacturing and operating golf club attachment mechanisms.

BACKGROUND

In some sports, an equipment fitting process may match an individual with equipment to help him or her play to the best of his or her abilities. In one example, the individual may be custom-fitted for a complete set of golf clubs (e.g., woods, irons, wedges, putter, etc.). A golf club fitter may allow the individual to try out various combinations of golf club heads and shafts. To properly fit the individual with a set of golf clubs, the golf club fitter may determine various preferences and/or characteristics of the individual (e.g., gender, height, age, wrist-to-floor distance, swing speed, etc.). In one example, a golf club fitter may determine whether the individual prefers to play with either right-handed golf clubs or left-handed golf clubs so that the individual may be fitted with proper golf equipment.

BRIEF DESCRIPTION OF THE DRAWINGS

FIG. 1 illustrates a side view of a golf club attachment mechanism having a hosel adapter, a shaft adapter, and a cap in a disengaged state, according to a first embodiment.

FIG. 2 illustrates a perspective view of the hosel adapter from FIG. 1.

FIG. 3 illustrates a side view of the hosel adapter from FIG. 1.

Figure 4:
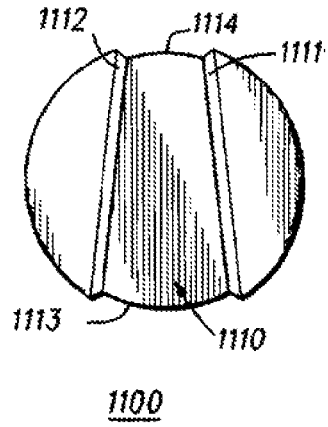
FIG. 4 illustrates a top view of the hosel adapter from FIG. 1.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf club attachment mechanism and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf club attachment mechanism and related methods described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

The terms "couple," "coupled" "couples," "coupling," and the like should be broadly understood and refer to connecting two or more elements or signals, electrically and/or mechanically, either directly or indirectly through intervening circuitry and/or elements. Two or more electrical elements may be electrically coupled, either direct or indirectly, but not be mechanically coupled; two or more mechanical elements may be mechanically coupled, either direct or indirectly, but not be electrically coupled; two or more electrical elements may be mechanically coupled, directly or indirectly, but not be electrically coupled. Coupling (whether only mechanical, only electrical, or both) may be for any length of time, e.g., permanent or semi-permanent or only for an instant.

The absence of the word "removably," "removable," and the like near the word "coupled," and the like does not mean that the coupling, etc. in question is or is not removable.

DETAILED DESCRIPTION

In one example, a golf club attachment mechanism comprises a hosel adapter with a first slot coupler across a top portion of the hosel adapter, and a shaft adapter with a second slot coupler across a bottom portion of the shaft adapter. The second slot coupler of the shaft adapter is complementary to the first slot coupler of the hosel adapter. The first slot coupler and the second slot coupler couple together to restrict a rotational movement of the hosel adapter relative to the shaft adapter. Other examples of golf dub attachment mechanisms and of methods to attach golf clubs are disclosed below.

Figure 5:
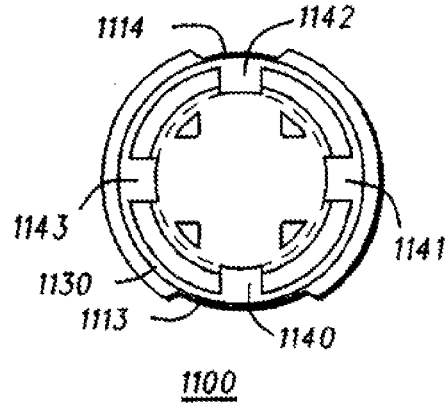
FIG. 5 illustrates a bottom view of the hosel adapter from FIG. 1.
Figure 6:
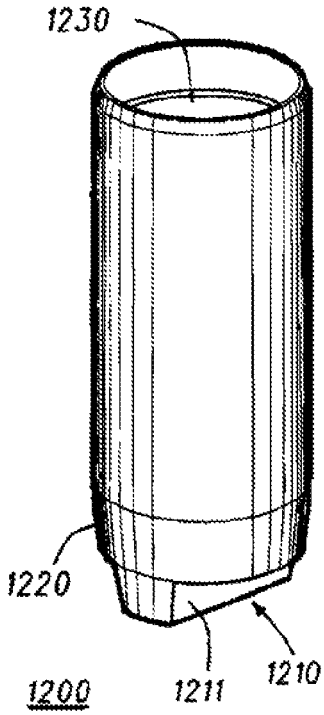
FIG. 6 illustrates a perspective view of the shaft adapter from FIG. 1.
Figure 8:
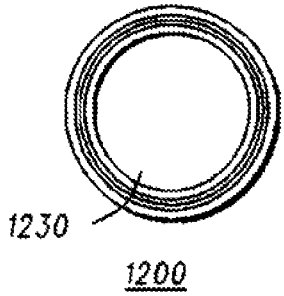
FIG. 8 illustrates a top view of the shaft adapter from FIG. 1.
Figure 9:
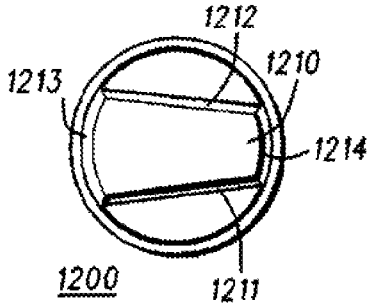
FIG. 9 illustrates a bottom view of the shaft adapter from FIG. 1.
Figure 7:
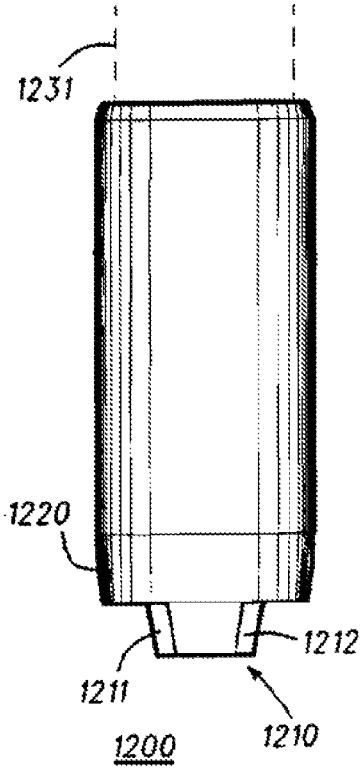
FIG. 7 illustrates a side view of the shaft adapter from FIG. 1.
Figure 10:
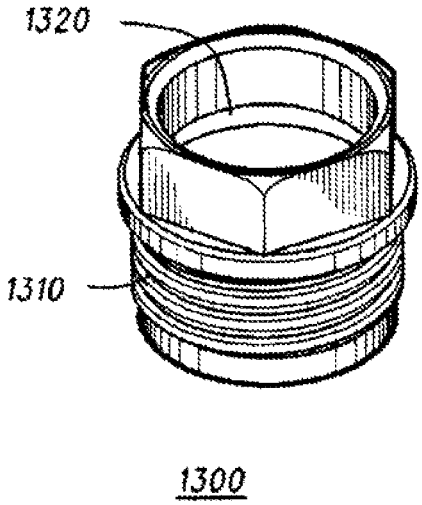
FIG. 10 illustrates a perspective view of the cap from FIG. 1.
Figure 11:
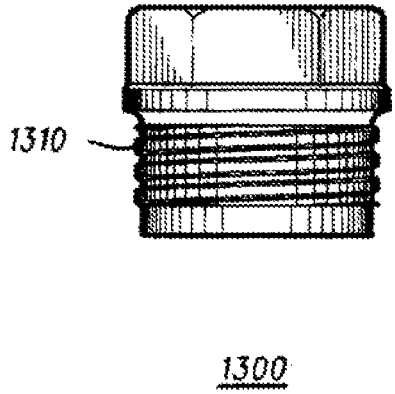
FIG. 11 illustrates a side view of the cap from FIG. 1.
Figure 12:
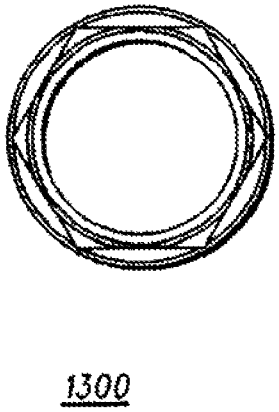
FIG. 12 illustrates a top view of the cap from FIG. 1.
Figure 13:
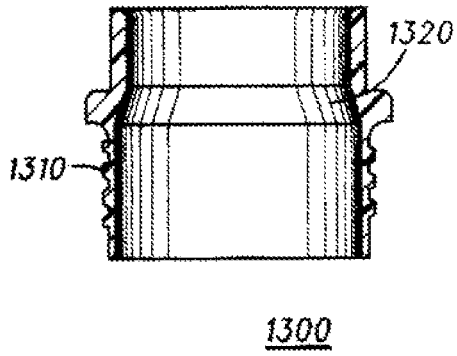
FIG. 13 illustrates a cross-sectional side view of the cap from FIG. 1.
Figure 24:
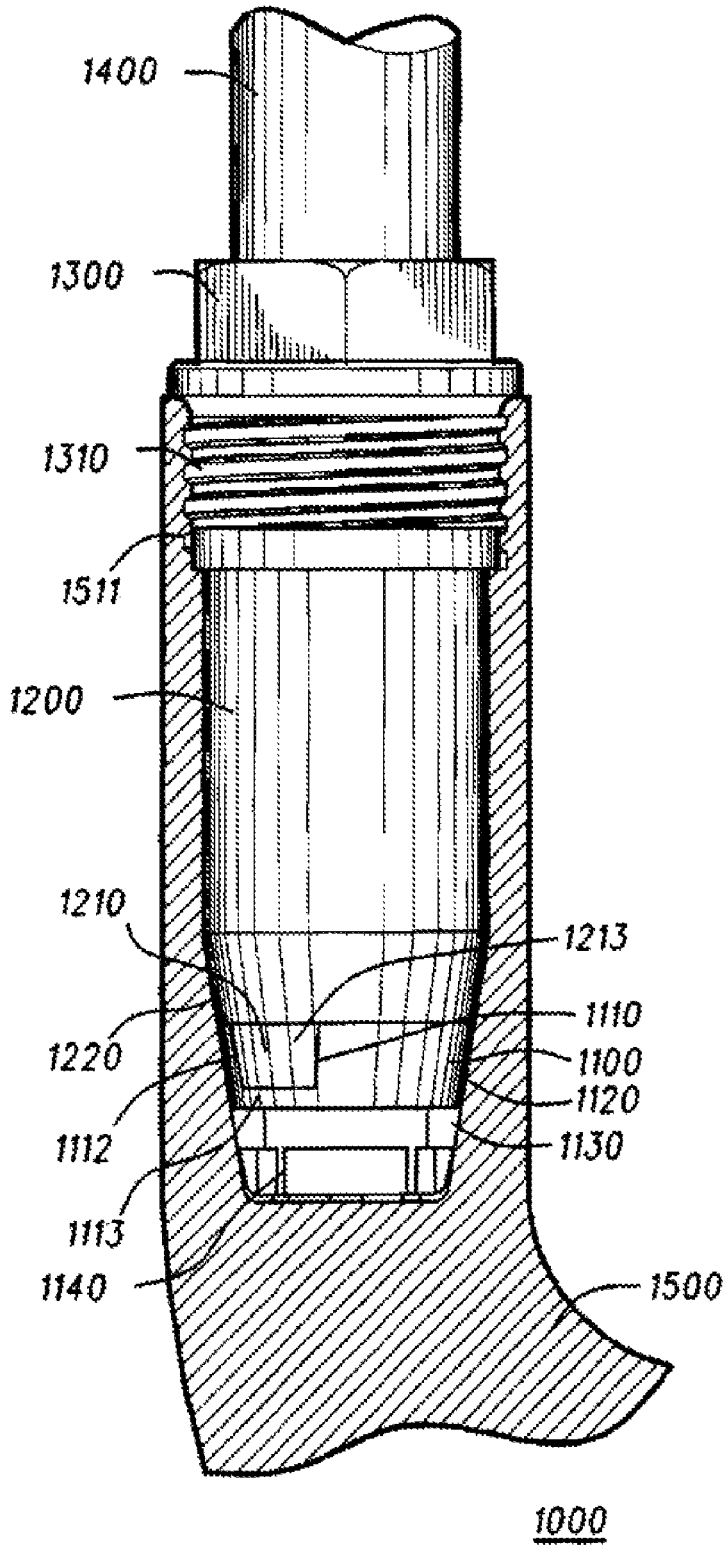
FIG. 24 illustrates a side view of the golf club attachment mechanism of FIG. 1 in an engaged state.

Referring now to the figures. FIG. 1 illustrates a side view of mechanism 1000 in a disengaged state. Mechanism 1000 includes hosel adapter 1100, shaft adapter 1200, and cap 1300, which are shown ready to be assembled to couple together golf club shaft 1400 and golf club head 1500. A portion of golf club head 1500 is shown in a cross-sectional view. FIG. 2 illustrates a perspective view of hosel adapter 1100. FIG. 3 illustrates a side view of hosel adapter 1100. FIG. 4 illustrates a top view of hosel adapter 1100. FIG. 5 illustrates a bottom view of hosel adapter 1100. FIG. 6 illustrates a perspective view of shaft adapter 1200. FIG. 7 illustrates a side view of shaft adapter 1200. FIG. 8 illustrates a top view of shaft adapter 1200. FIG. 9 illustrates a bottom view of shaft adapter 1200. FIG. 10 illustrates a perspective view of cap 1300. FIG. 11 illustrates a side view of cap 1300. FIG. 12 illustrates a top view of cap 1300. FIG. 13 illustrates a cross-sectional side view of cap 1300. Skipping ahead in the figures, FIG. 24 illustrates a side view of mechanism 1000 in an engaged state, showing hosel adapter 1100, shaft, adapter 1200, and cap 1300 assembled to couple together golf club shaft 1400 with golf club head 1500.

Golf club shaft 1400 can comprise any various golf club shaft made of various materials (e.g. steel, graphite, etc.) with various characteristics (e.g., flex bend point, etc.). In the same or a different example, golf club shaft 1400 may be manufactured or otherwise modified to accommodate the use of mechanism 1000. In the same or a different example, golf club shaft 1400 can be manufactured or designed to limit flexing to be: (a) along a flex plane relative to a swing path of golf club shaft 1400 and/or (b) at one or more regions of golf club shaft 1400.

Similarly, golf club head 1500 in FIGS. 1-13 can comprise a golf club head, including putter, iron, hybrid, fairway wood, and driver-type golf club heads. Golf club head 1500 also comprises hosel 1510. In the same or a different example, hosel 1510 may be manufactured or modified to accommodate mechanism 1000. For example, hosel 1510 may be bored or drilled to accommodate shaft adapter 1200 and hosel adapter 1100. In the same or a different example, hosel 1510 may be modified to include hosel fastener 1511 that can be used to couple cap 1300 to hosel 1510. In the example illustrated in FIG. 1, hosel fastener 1511 is located at a top portion of hosel 1510, and comprises screw threads at the periphery of hosel 1510. Other types of hosel fasteners besides screw threads can be used without departing from the embodiments disclosed herein.

In a different embodiment, golf club head 1500 can be devoid of a hosel, and just have a hole in which mechanism 1000 is inserted. In this embodiment, hosel adapter 1100 can be inserted into the hole of the golf club head. Therefore, hosel adapter 1100 and other hosel adapters described later can also be used with hosel-less golf club heads.

Proceeding now to describing the elements of mechanism 1000, FIGS. 1-13 illustrate hosel adapter 1100, shaft adapter 1200, and cap 1300. In the present example illustrated in FIGS. 1-5, hosel adapter 1100 comprises slot coupler 1110 across a top portion of hosel adapter 1100. In some embodiments, hosel adapter 1100 can be referred to as a hosel plug, while slot coupler 1110 can comprise a slot or a trench located at a top end of hosel adapter 1100.

Hosel adapter 1100 is designed to couple within hosel 1510 of golf club head 1500. To assist in coupling with hosel 1510, a perimeter of hosel adapter 1100 comprises groove 1130. In the example shown in FIGS. 1-5, groove 1130 of hosel adapter 1100 circumscribes the perimeter of hosel adapter 1100 completely in a substantially horizontal plane with respect to hosel 1510. In other embodiments, groove 1130 could circumscribe the perimeter of hosel adapter 1100 only partially or non-continuously, and/or there could be other similar grooves in addition to groove 1130.

In addition, hosel adapter 1100 further comprises groove 1140, which is substantially perpendicular to groove 1130. In the example shown in FIGS. 1-5, groove 1140 is also located at the perimeter of hosel adapter 1100, but is substantially vertical to groove 1130. In the present embodiment, hosel adapter 1100 also comprises grooves 1141, 1142, and 1143, which are similar to groove 1140 but located at different points of the perimeter of hosel adapter 1100. Grooves 1140, 1141, 1142, and 1143 can be equidistant from each other.

In the present example, as shown in FIG. 1, hosel adapter 1100 comprises tapering 1120 that allows hosel adapter 1100 to fit complementary to an inner perimeter at a bottom portion of hosel 1510. To couple hosel adapter 1100 and hosel 1510 together, an epoxy material (not shown) can be applied between the perimeter of hosel adapter 1100 and the inner perimeter of hosel 1510. Groove 1130 and/or grooves 1140,

1141, 1142, and/or 1143 can serve to channel the epoxy material throughout the perimeter of hosel adapter 1100, and to provide enhanced surface area to which the epoxy material can more firmly attach while securing hosel adapter 1100 to hosel 1510.

Continuing with the elements of mechanism 1000, in the present example illustrated in FIGS. 1 and 6-9, shaft adapter 1200 comprises slot coupler 1210 across a bottom portion of shaft adapter 1200. In some embodiments, shaft adapter 1200 can be referred to as a shaft sleeve, while slot coupler 1210 can comprise a tab or a protrusion located at a bottom end of shall adapter 1200. Slot coupler 1210 of shaft adapter 1200 is complementary to slot coupler 1110 of hosel adapter 1100, as will be further described below.

Shaft adapter 1200 is designed to couple with an end of golf club shaft 1400. In the present example, as better illustrated in FIGS. 6-9 shaft adapter 1200 comprises bore 1230 complementary to an exterior perimeter of golf club shaft 1400. FIG. 1 shows shaft adapter 1200 of the present example coupled to golf club shaft 1400, with the end of golf club shaft 1400 already inserted into bore 1230 of shaft, adapter 1200. In a different example, instead of bore 1230, shaft adapter 1200 could comprise rod 1231, shown in outline form in FIG 7, to couple within an interior perimeter (not shown) of the end of golf club shaft 1400. Shafter adapter 1200 can be epoxied to golf club shaft 1400.

In the present example, as shown in FIG. 1, shaft adapter 1200 comprises tapering 1220, which can allow shaft adapter 1200 to couple with hosel adapter 1100 while fitting complementary to the inner perimeter of hosel 1510. Tapering 1220 can be substantially continuous with tapering 1120 of hosel adapter 1100 when shaft adapter 1200 and hosel adapter 1100 are coupled together.

Carrying on with the elements of mechanism 1000, as illustrated in FIG. 1 for the present example, cap 1300 is located at least partially above shaft adapter 1200 while circumscribing the exterior perimeter of golf club shaft 1400. In some embodiments, cap 1300 can be referred to as a nut.

As illustrated in FIGS. 1 and 10-13, cap 1300 comprises cap fastener 1310 at a perimeter of cap 1300. In the example illustrated in FIGS. 1, and 10-13, cap fastener 1310 comprises screw threads which are complementary to the screw threads of hosel fastener 1511 described earlier for hosel 1510. Besides screw threads, other combinations of complementary cap and hosel fasteners are possible without deviating from the embodiments presented herein. In some embodiments, cap fastener 1310 can be referred to as a nut fastener.

In the present example, at least part of an interior perimeter of cap 1300 is complementary with, and fits around, an exterior perimeter of shaft adapter 1200 while cap fastener 1310 couples with hosel fastener 1511. In addition, as better illustrated in FIGS. 10 and 13, cap 1300 further comprises cap flange 1320, which may be referred to as a nut flange in some embodiments. In the present embodiment, cap flange 1320 comprises an interior flange that narrows part of the inner perimeter of cap 1300 to a dimension complementary to the exterior perimeter of golf club shaft 1400. In other embodiments, cap flange 1320 can be located at a bottom side of cap 1300, and all of the interior perimeter of cap 1300 can be complementary to the exterior perimeter of golf club shaft 1400.

To engage mechanism 1000, as better illustrated in FIG. 1 for the present example, cap flange 1320 engages a top end of shaft adapter 1200, pushing shaft adapter 1200 against hosel adapter 1100 while cap fastener 1310 couples with hosel fastener 1511. This interaction causes slot coupler 1210 of shaft adapter 1200 to engage slot coupler 1110 of hosel adapter 1100. When coupled together as such, slot couplers 1210 and 1110 restrict a rotational movement of hosel adapter 1100 relative to shaft adapter 1200, and this in turn maintains golf club shaft 1400 and golf club head 1500 at a predetermined desired orientation with respect to each other. In some embodiments, hosel adapter 1100 and shaft adapter 1200 remain entirely within hosel 1510 when cap 1300 is fully coupled to hosel 1510.

Continuing with a further description of the interaction between shaft adapter 1200 and hosel adapter 1100 of mechanism 1000, in the present example of FIGS. 1-13, slot coupler 1110 comprises a slot, while slot coupler 1210 comprises a tab complementary to the slot of slot coupler 1110. In at least some embodiments, slot coupler 1110 can comprise a trench, while slot coupler 1210 can comprise a protrusion complementary to the trench of slot coupler 1110. In a different example, the physical attributes of slot couplers 1110 and 1210 could be inverted, where slot coupler 1210 would comprise a slot or a trench, while slot coupler 1110 would comprise a tab or protrusion complementary to the slot of slot coupler 1210.

In the present example, as shown in FIGS. 1-9, slot coupler 1110 further comprises surface 1111 and surface 1112, where surface 1112 in non-planar and non-parallel to surface 1111 in two dimensions. Similarly, slot coupler 1210 further comprises surface 1211 and surface 1212, where surface 1212 is non-planar and non-parallel to surface 1211 in two dimensions. In at least some embodiments, surfaces 1111, 1112, 1211, and/or 1212 can be referred as walls.

As better illustrated in FIGS. 4 and 9 for the present embodiment, slot coupler 1110 tapers across the top portion of hosel adapter 1100, from end 1113 to end 1114, where end 1114 of slot coupler 1110 is narrower than end 1113 of slot coupler 1110 in two dimensions. In addition, slot coupler 1210 tapers complementary to slot coupler 1110 across the bottom portion of shaft adapter 1200, from end 1213 to end 1214, where end 1214 of slot coupler 1210 is narrower than end 1213 of slot coupler 1210 in two dimensions. The tapering of slot couplers 1110 and 1210 is reflected by a varying width between surfaces 1111 and 1113, and between surfaces 1211 and 1212.

In the present example, when slot couplers 1110 and 1210 are coupled together while mechanism 1000 is engaged, surface 1111 of slot coupler 1110 engages surface 1211 of slot coupler 1210, while surface 1112 of slot coupler 1110 engages surface 1212 of slot coupler 1210. In some embodiments, slot coupler 1110 further comprises a slope, which changes the depth of the slot or trench, while slot coupler 1210 comprises a slope complementary to the slope of slot coupler 1110, which changes the height of the tab or protrusion. In these embodiments, the dimensions of slot couplers 1110 and 1210 vary in three dimensions from end to end.

For the example of FIGS. 1-13, due to the varying width between, and the complementary nature of, surfaces 1111, 1112, 1211, and 1212, slot couplers 1110 and 1210 are coupled together at a specific orientation with respect to each other. Otherwise, the tab of slot coupler 1210 would not fit within the slot of slot coupler 1110, and cap 1300 would therefore not be able to push shaft adapter 1200 far enough into hosel 1510 to allow hosel fastener 1511 and cap fastener 1310 to properly engage mechanism 1000.

In contrast, when mechanism 1000 is properly engaged by securing cap 1300 to maintain slot couplers 1110 and 1210 coupled together, the interaction between complementary surfaces 1111, 1112, 1211, and 1212 maintain the relative alignment of shaft adapter 1200 and hosel adapter 1100 to each other. This engagement, in turn, sustains the predetermined desired orientation of golf club shaft 1400 relative to golf club head 1500.

Figure 14:
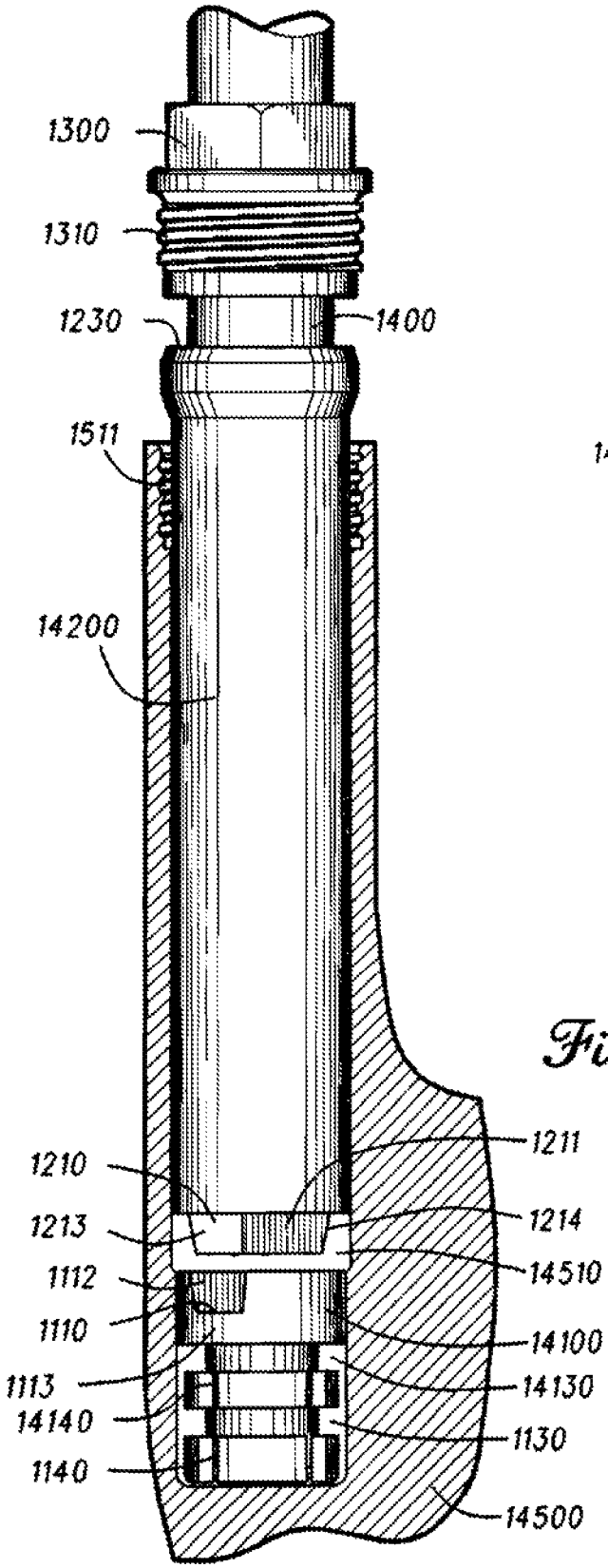
FIG. 14 illustrates a side view of a golf club attachment mechanism in a disengaged state, according to a second embodiment.
Figure 15:
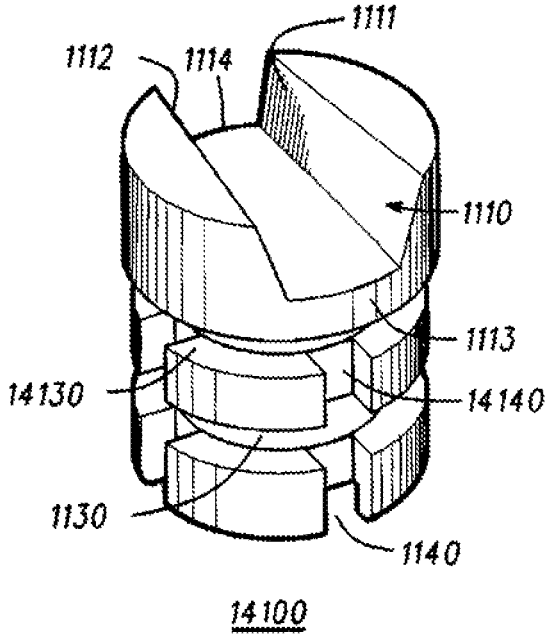
FIG. 15 illustrates a perspective view of a hosel adapter from the golf club attachment mechanism of FIG. 14.
Figure 16:
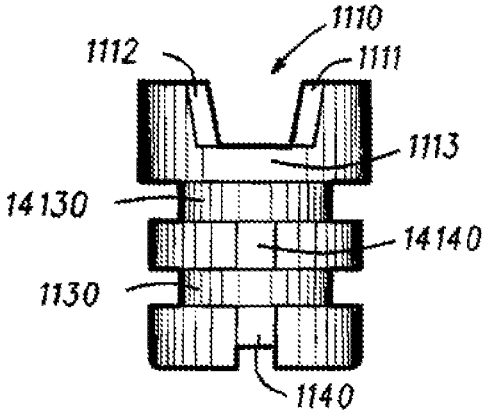
FIG. 16 illustrates a side view of the hosel adapter of FIG. 15.
Figure 17:
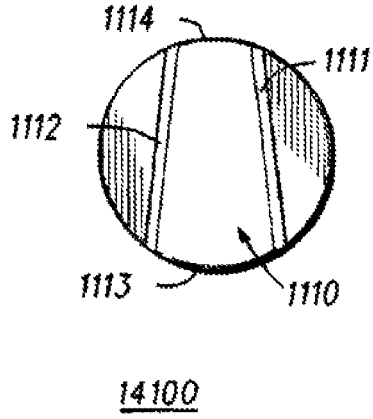
FIG. 17 illustrates atop view of the hosel adapter of FIG. 15.
Figure 18:
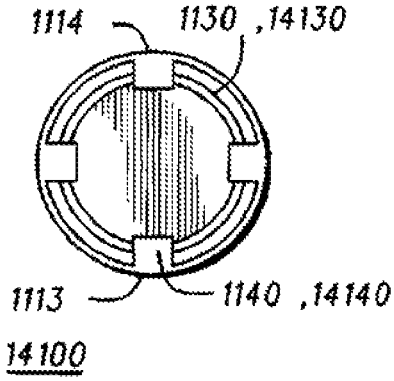
FIG. 18 illustrates a bottom view of the hosel adapter of FIG. 15.
Figure 19:
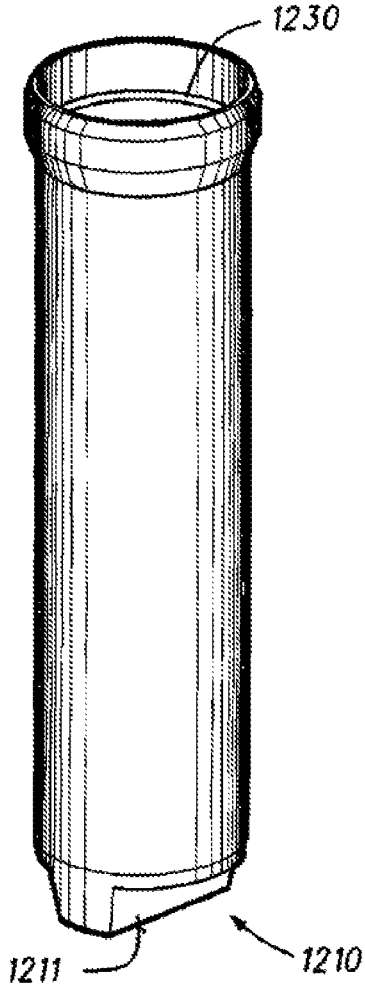
FIG. 19 illustrates a perspective view of a shaft adapter from the golf club attachment mechanism of FIG. 14.
Figure 20:
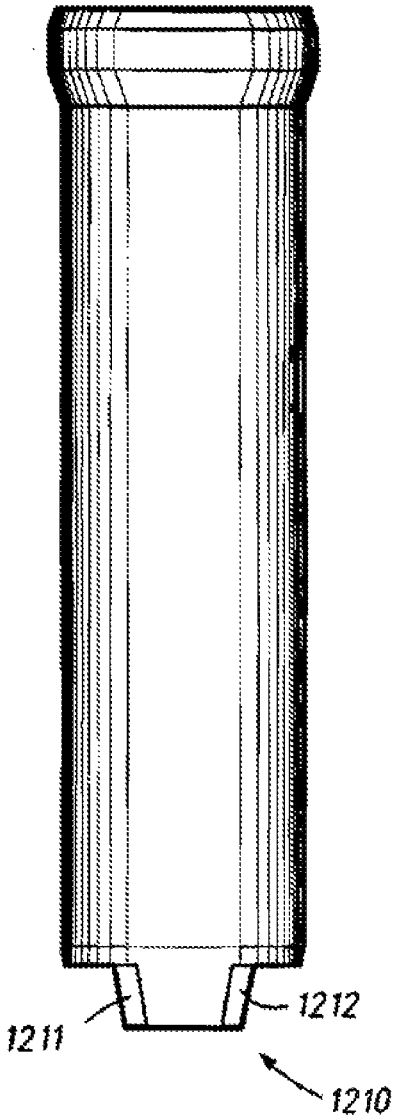
FIG. 20 illustrates a side view of the shaft adapter of FIG. 19.
Figure 21:
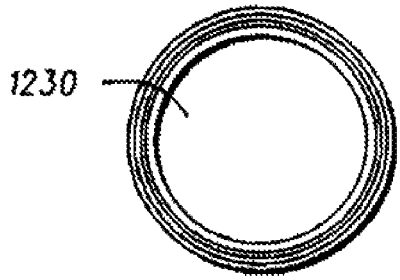
FIG. 21 illustrates a top view of the shaft adapter of FIG 19.
Figure 22:
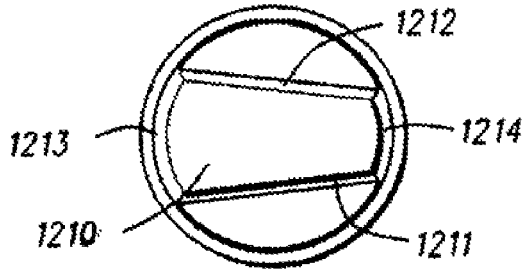
FIG. 22 illustrates a bottom view of the shaft adapter of FIG 19.
Figure 25:
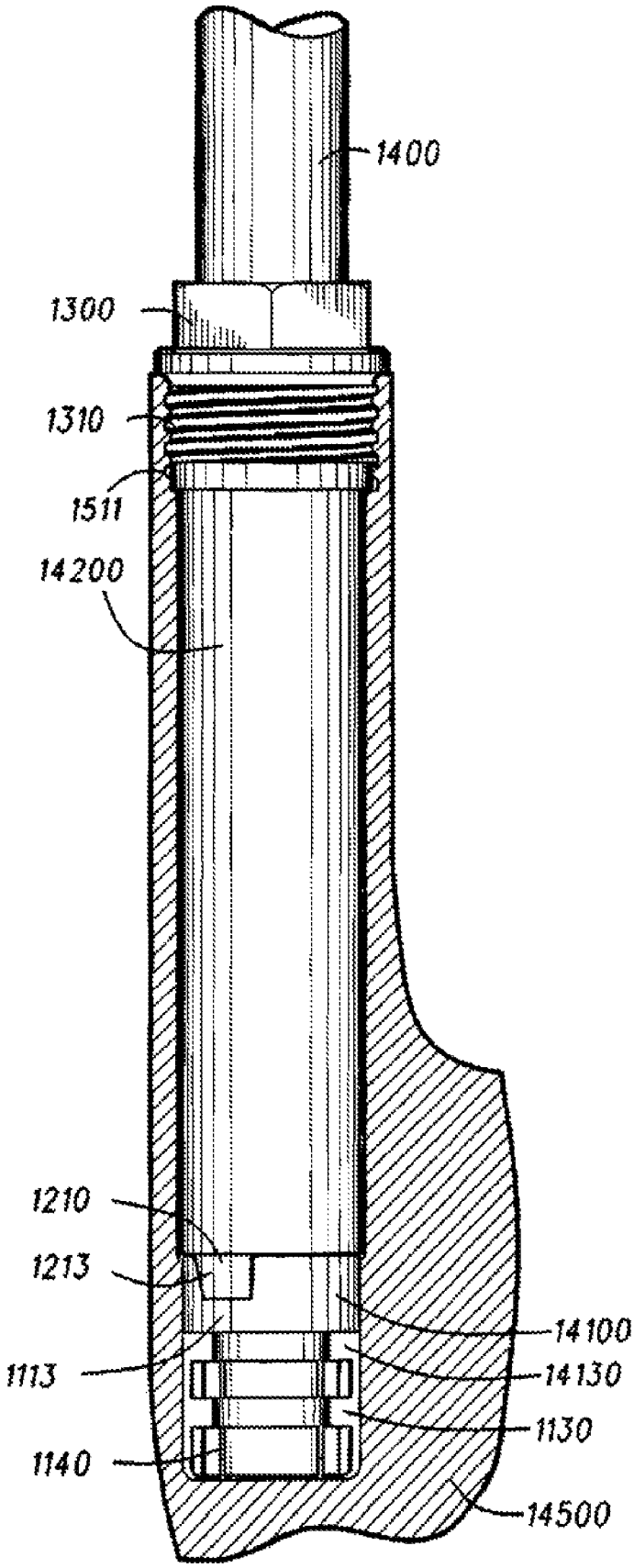
FIG. 25 illustrates a side view of the golf club attachment mechanism of FIG 14 in an engaged state.

Continuing with the figures. FIG. 14 illustrates a side view of mechanism 14000 in a disengaged state. Mechanism 14000 includes hosel adapter 14100, shaft adapter 14200, and cap 1300, which are shown ready to be assembled to couple together golf club shaft 1400 and golf club head 14500. A portion of golf club head 14500 is shown in a cross-sectional view. FIG. 15 illustrates a perspective view of hosel adapter 14100. FIG. 16 illustrates a side view of hosel adapter 14100. FIG. 17 illustrates a top view of hosel adapter 14100. FIG. 18 illustrates a bottom view of hosel adapter 14100. FIG. 19 illustrates a perspective view of shaft adapter 14200. FIG. 20 illustrates a side view of shaft adapter 14200. FIG. 21 illustrates a top view of shaft adapter 14200. FIG. 22 illustrates a bottom view of shaft, adapter 14200. Skipping ahead in the figures. FIG. 25 illustrates a side view of mechanism 14000 in an engaged state, showing hosel adapter 14100, shaft adapter 14200, and cap 1300 assembled to couple together golf club shaft 1400 with golf club head 14500.

Mechanism 14000 is similar to mechanism 1000 of FIGS. 1-13, serving similar purposes for coupling golf club heads and golf club shafts together at a predetermine desired orientation with respect to each other. In the present embodiment, however, an inner perimeter of hosel 14510 of golf club shaft 14500 is substantially constant, and thus does not vary in width in contrast to hosel 1510 in FIG. 1. In at least some embodiments, golf club head 14500 can comprise a driver-type golf club head, where a material thickness around hosel 14510 is sufficient to accommodate mechanism 14000 and maintain structural integrity without needing to vary a width of the inner perimeter for hosel 14510. This contrasts with golf club head 1500 (FIG. 1), where the varying width of the inner perimeter of hosel 1510 can compensate for a thinner material thickness around hosel 1510, allowing sufficient structural integrity for hosel 1.510 to resist impact forces while still accommodating mechanism 1000.

As illustrated in FIGS. 14 and 19-22, mechanism 14000 comprises a shaft adapter 14200, which is similar to shaft adapter 1200 of mechanism 1000 in FIGS. 1 and 6-9. In the present example, shaft adapter 14200 comprises no tapering, unlike shaft adapter 1200 which comprises tapering 1220. Furthermore, as illustrated in FIGS. 14-18, mechanism 14000 comprises a hosel adapter 14100, which is similar to hosel adapter 1100 of mechanism 1000 in FIGS. 1-5. However, because the inner perimeter of hosel 14510 is substantially constant, hosel adapter 14100 too has a substantially constant perimeter. Thus, hosel adapter 14100 comprises no tapering, in contrast to hosel adapter 1100 which does comprise tapering 1120 (FIGS. 1-3).

Hosel adapter 14100 (FIGS. 14-18) shares with hosel adapter 1100 (FIGS. 1-5) grooves 1130 and 1140. In addition, hosel adapter 14100 further comprises additional grooves 14130 and 14140. Groove 14130 is similar and substantially parallel to groove 1130. Groove 14140 is similar and substantially parallel to, and can be collinear with, groove 1140, and is further substantially perpendicular to grooves 1130 and 14130. The additional grooves serve the same purpose of grooves 1130 and 1140, but allow greater surface area for the epoxy material to attach to while securing hosel adapter 14100 to hosel 14510.

Figure 23:
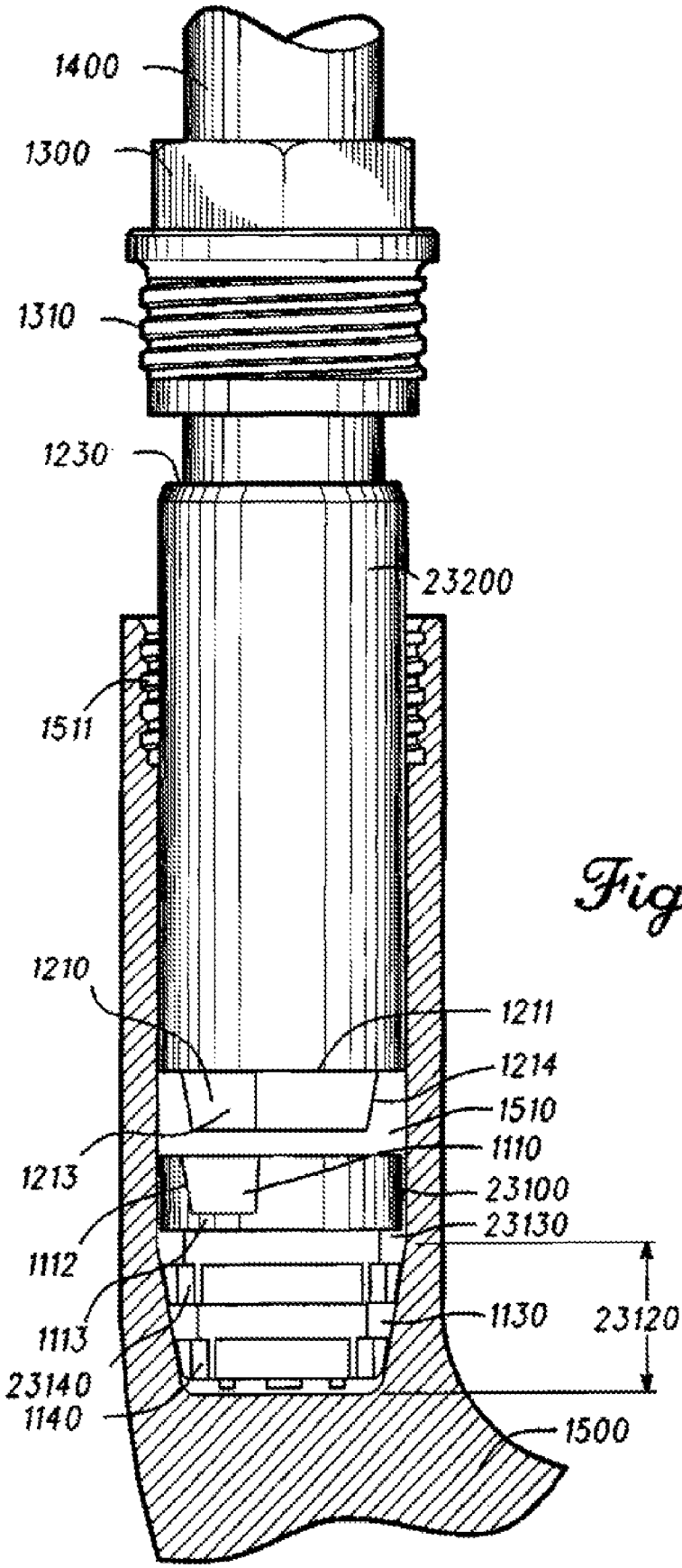
FIG. 23 illustrates a side view of a golf club attachment mechanism in a disengaged state, according to another embodiment.
Figure 26:
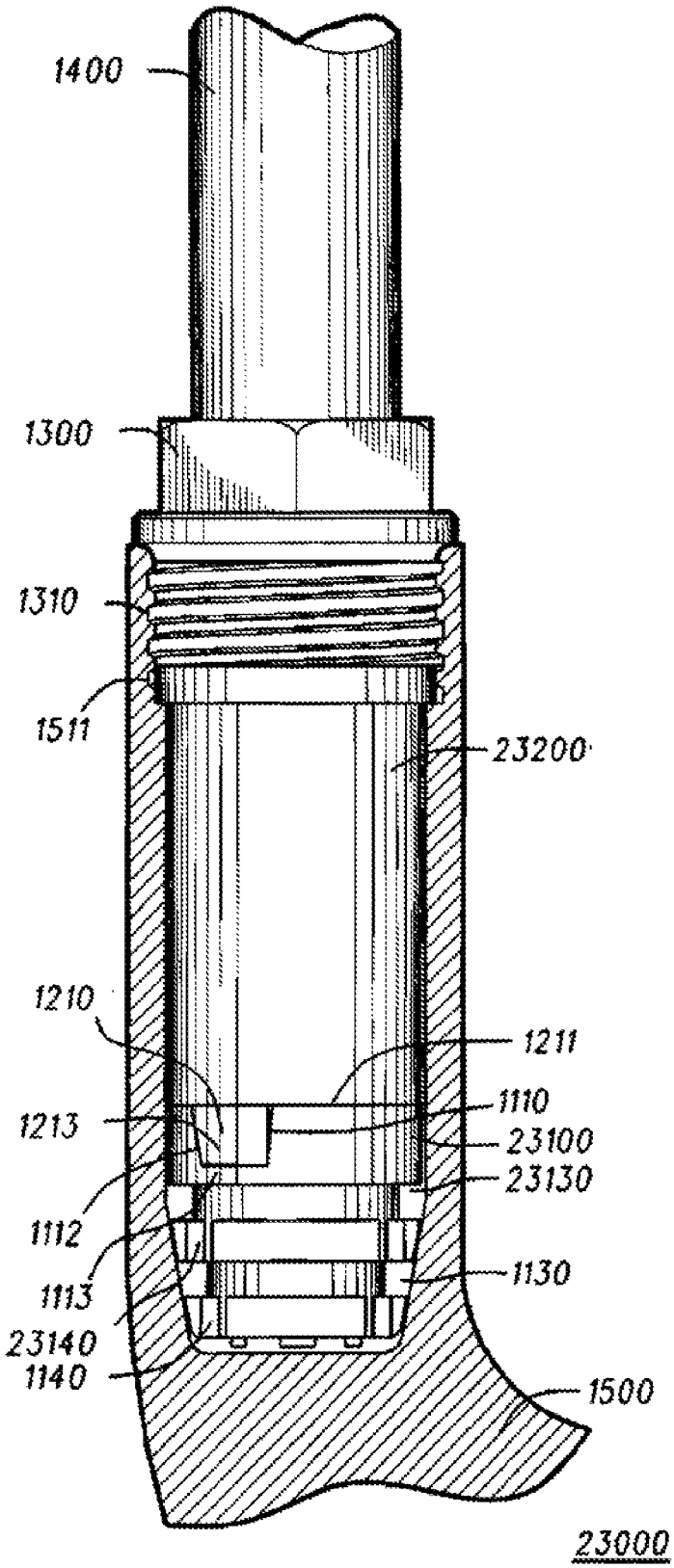
FIG. 26 illustrates a side view of the golf club attachment mechanism of FIG. 23 in an engaged state.

Continuing with the figures. FIG. 23 illustrates a side view of mechanism 23000 in a disengaged state. Mechanism 23000 includes hosel adapter 23100, shaft adapter 23200, and cap 1300, which are shown ready to be assembled to couple together golf club shaft 1400 and golf club head 1500. FIG. 26 illustrates a side view of mechanism 23000 in an engaged state, showing hosel adapter 23100, shaft adapter 23200, and cap 1300 assembled to couple together golf club shaft 1400 with golf club head 1500. Mechanism 23000 is similar to mechanism 1000 of FIGS. 1-13, differing mainly in how the different elements of mechanism 23000 conform to the inner perimeter of hosel 1510.

Mechanism 23000 comprises a shaft adapter 23200, which is similar to shaft adapter 1200 of mechanism 1000 in FIGS. 1 and 6-9. In the present example, shaft adapter 23200 comprises no tapering, unlike shaft adapter 1200 which comprises tapering 1220.

In addition, mechanism 23000 comprises a hosel adapter 23100, which is similar to hosel adapter 1100 of mechanism 1000 in FIGS. 1-5. Hosel adapter 23100, which is longer than hosel adapter 1100, compensates for the shorter length of shaft adapter 23200, as compared to shaft, adapter 1200. As a result, tapering 23120 of hosel adapter 23100 engages a full height of the bottom portion of the inner perimeter of hosel 1510 that varies in width. Thus, shaft adapter 2320 can be devoid of any tapering. This configuration contrasts with hosel adapter 1100 as shown in FIGS. 1-3, where tapering 1120 only partially engages the height of the bottom portion of hosel 1510, thus requiring shaft adapter 1200 to have its own tapering 1220 to accommodate the inner perimeter of hosel 1510.

Hosel adapter 23100 shares with hosel adapter 1100 (FIGS. 1-5) grooves 1130 and 1140. In addition, hosel adapter 23100 can further comprise additional grooves, such as grooves 23130 and 23140. Groove 23130 is similar and substantially parallel to groove 1130, while groove 23140 is similar and substantially parallel to groove 1140, and further substantially perpendicular to groove 23130. The additional grooves serve the same purpose of grooves 1130 and 1140, but allow greater surface area for the epoxy material to attach to while securing hosel adapter 23100 to hosel 1510.

Figure 27:
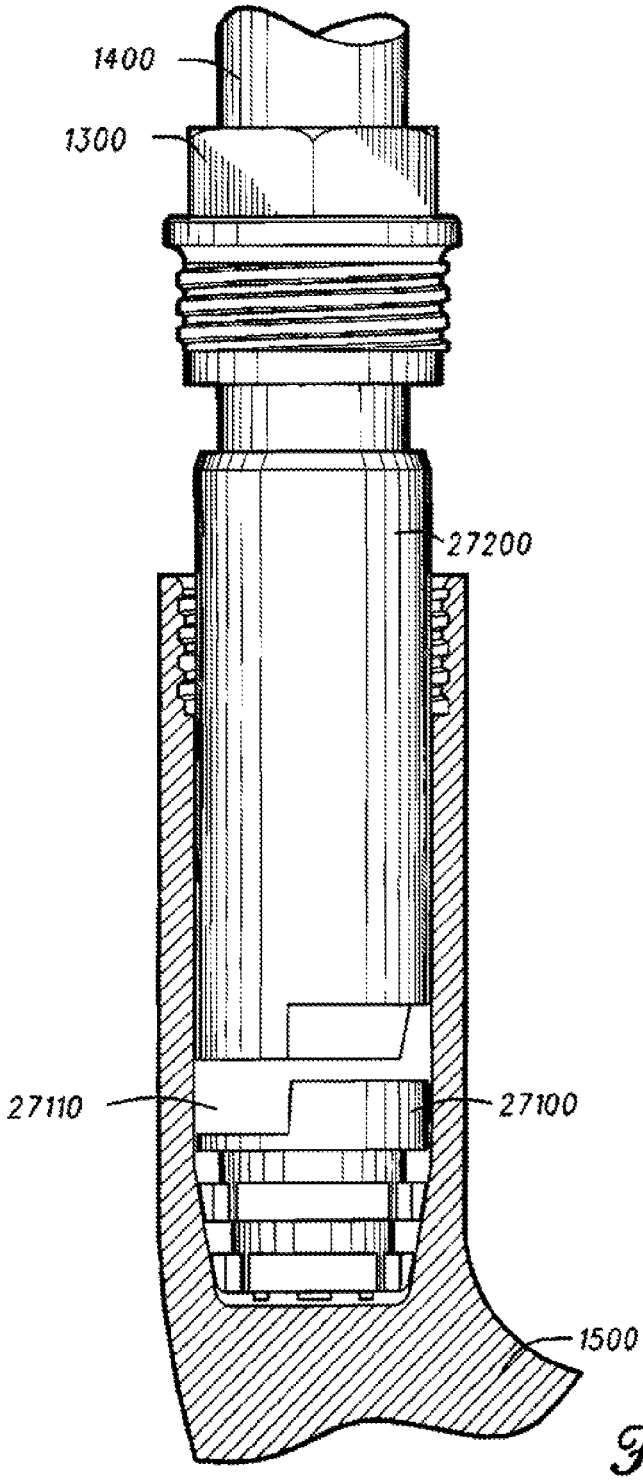
FIG. 27 illustrates a side view of a golf club attachment mechanism in a disengaged state, according to yet another embodiment.
Figure 28:
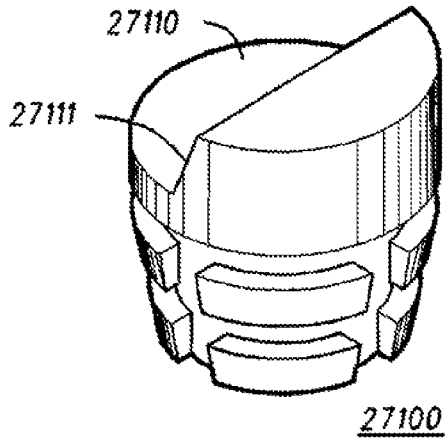
FIG. 28 illustrates a perspective view of a hosel adapter from the golf club attachment mechanism of FIG. 27.
Figure 29:
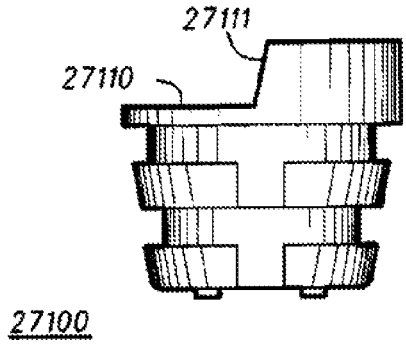
FIG. 29 illustrates a side view of the hosel adapter of FIG. 28.
Figure 31:
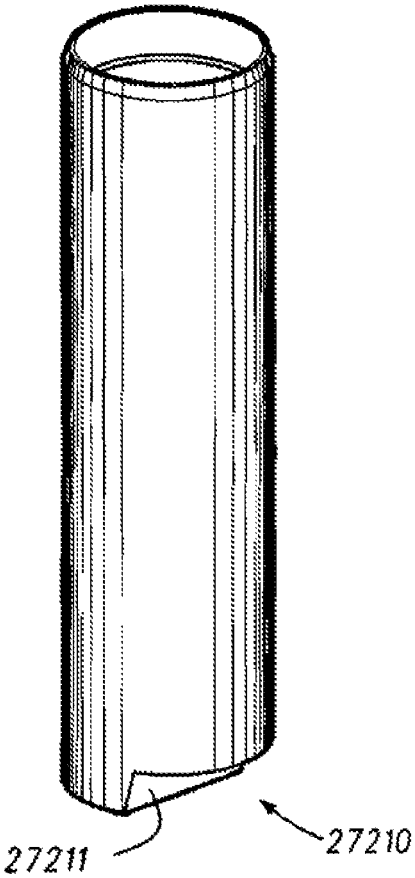
FIG. 31 illustrates a perspective view of a shaft adapter from the golf club attachment mechanism of FIG. 27.
Figure 30:
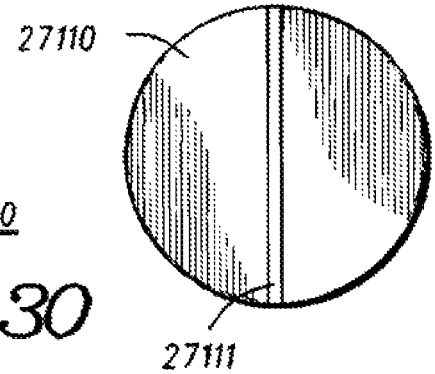
FIG. 30 illustrates atop view of the hosel adapter of FIG. 28.
Figure 33:
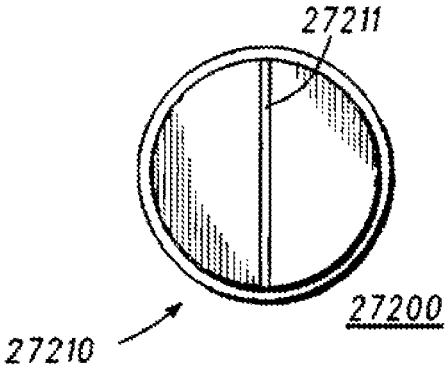
FIG. 33 illustrates a bottom view of the shaft adapter of FIG 31.
Figure 32:
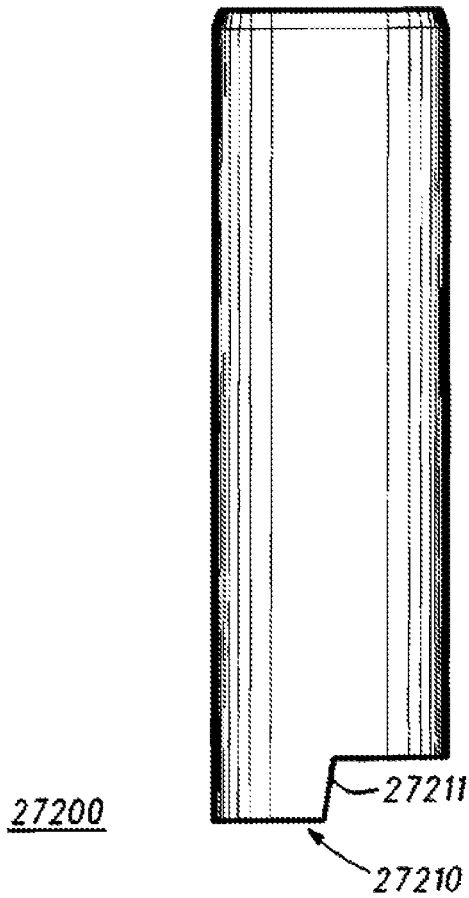
FIG. 32 illustrates a side view of the shaft adapter of FIG 31.

Continuing with the figures. FIG. 27 illustrates a side view of mechanism 27000 in a disengaged state. Mechanism 27000 includes hosel adapter 27100, shaft adapter 27200, and cap 1300, which are shown ready to be assembled to couple together golf club shaft 1400 and golf club head 1500. FIG. 28 illustrates a perspective view of hosel adapter 27100. FIG. 29 illustrates a side view of hosel adapter 27100. FIG. 30 illustrates a top view of hosel adapter 27100. FIG. 31 illustrates a perspective view of shaft adapter 27200. FIG. 32 Illustrates a side view of shaft adapter 27200. FIG. 33 illustrates a top view of shaft adapter 27200.

Mechanism 27000 is similar to mechanisms 1000, 14000, and 23000 of FIGS. 1-26, respectively, serving similar purposes of coupling golf club heads and golf club shafts together at a predetermined desired orientation with respect to each other. Mechanism 27000 differs, however, with respect to the structure of slot coupler 27110 in hosel adapter 27100, and of slot coupler 27210 in shaft adapter 27200.

In the present example, as best illustrated in FIGS. 28-30, slot coupler 27110 of hosel adapter 27100 comprises a half-slot structure having surface 27111. The half-slot contrasts with the slot couplers of the hosel adapters in the mechanisms described above, which instead comprise a full slot having surfaces 1111 and 1112 opposite each other forming two separate walls of the full slot, as illustrated, for example, in FIGS. 2-4.

Similarly, as best illustrated in FIGS. 31-33, slot coupler 27210 of shaft adapter 2720 comprises a half-tab structure, having surface 27211, and being complementary to the half slot of slot coupler 27110. The half-tab contrasts with the slot couplers of the shaft adapters in the mechanisms described above, which instead comprise a full tab having surfaces 1211 and 1212 opposite each other forming two separate walls of the full tab, as illustrated, for example, in FIGS. 6-9. In some embodiments, the half-slot can be referred to as a half-tab. Similarly, the half-tab can be referred to as a half-protrusion.

In operation, notwithstanding structural differences, mechanism 27000 serves the same purposes of other mechanisms described above, where slot couplers 27110 and 27210 couple together to restrict a rotational movement of hosel adapter 27100 relative to shaft adapter 27200 via the complementary interaction of surfaces 27111 and 27211. Slot couplers 27100 and 27210 can have similar variations in one, two, or three dimensions from end to end, as described for the previous slot couplers.

Figure 34:
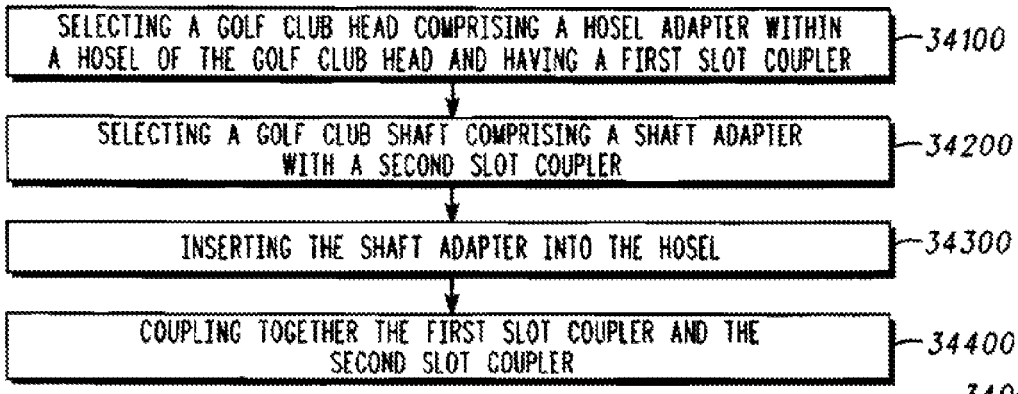
FIG. 34 illustrates a flowchart of method for operating a golf club attachment mechanism, according to an embodiment.

Continuing with the figures. FIG. 34 illustrates a flowchart of method 34000 for operating a golf club attachment mechanism. As an example, the golf club attachment mechanism in method 34000 can be mechanism 1000 in FIG. 1, mechanism 14000 in FIG. 14, mechanism 23000 in FIG. 23, and mechanism 27000 in FIG. 27.

Block 34100 of method 34000 involves selecting a golf club head comprising a hosel adapter within a hosel of the golf club head and having a first slot coupler. In one embodiment, the first slot coupler of the hosel adapter of block 34100 can be similar to slot coupler 1110 of mechanism 1000 in FIG. 1, or any other similar slot coupler for the other golf club attachment mechanisms described above. In one example, part of block 34100 can comprise attaching the hosel adapter to a bottom of the hosel, such as described for hosel adapter 1100 (FIG. 1) being attached to hosel 1510 (FIG. 1).

Block 34200 of method 34000 involves selecting a golf club shaft comprising a shaft adapter with a second slot coupler. In one embodiment, the second slot coupler of the shaft adapter of block 34200 can be similar to slot coupler 1210 of mechanism 1000 in FIG. 1, or any other similar slot coupler for the other golf club attachment mechanisms described above. In one example, part of block 34200 can comprise attaching the shaft adapter to an end of the golf club shaft, such as described for shaft adapter 1200 (FIG. 1) being attached to an end of golf club shaft 1400 (FIG. 1).

Block 34300 of method 34000 involves Inserting the shaft adapter of block 34200 into the hosel of block 34100. As an example, the shaft adapter can be inserted into the hosel as illustrated for FIG. 1, where shaft adapter 1200, being complementary to the interior of hosel 1510, traverses the interior length or depth of hosel 1510 until slot coupler 1210 of shaft adapter 1200 contacts slot coupler 1110 of hosel adapter 1100.

Block 34400 of method 34000 comprises coupling together the first slot coupler of block 34100 and the second slot coupler of block 34200. Block 34400 can be accomplished as illustrated for slot couplers 1110 and 1210 of mechanism 1000 in FIG. 1, or for any similar slot couplers of any of the golf club attachment mechanisms described above. In some examples, block 34400 can involve one or more sub-steps, as described below for method 35000.

Figure 35:
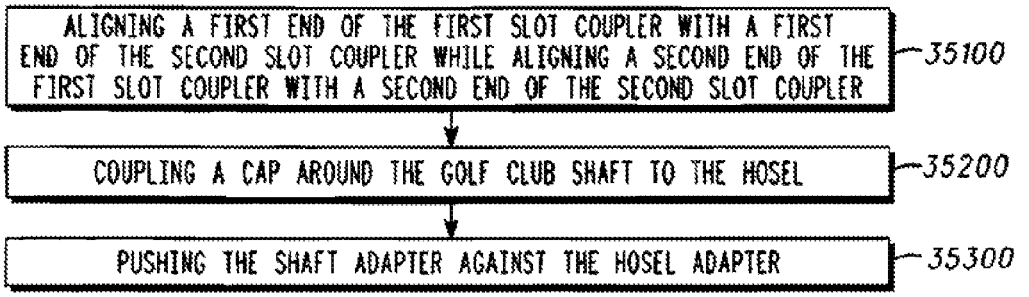
FIG. 35 illustrates a method for coupling together a first slot coupler and a second slot coupler of a golf club attachment mechanism, according to another embodiment.

FIG. 35 illustrates a method 35000 for coupling together a first slot coupler and a second slot coupler of a golf club attachment mechanism. In one example, the first and second slot couplers of method 35000 can be the first and second slot couplers of block 34400 as described for method 34000 (FIG. 34), including the respective slot coupler pairs for mechanism 1000 of FIG. 1, mechanism 1400 of FIG. 14, mechanism 2100 of FIG. 21, and mechanism 27000 of FIG. 27.

Block 35100 of method 35000 involves aligning a first end of the first slot coupler with a first end of the second slot coupler, and aligning a second end of the first slot coupler with a second end of the second slot coupler. Block 35100 can also be divided into two separate blades, each comprising a different one of the aligning processes. In one embodiment, the first end and the second end of the first slot coupler can be similar to end 1114 and end 1113, respectively, of slot coupler 1110 as illustrated for mechanism 1000 in FIG. 4. In the same or a different embodiment, the first end and the second end of the second slot coupler can be similar to end 1214 and end 1213, respectively, of slot coupler 1210 as illustrated for mechanism 1000 in FIG. 9.

In some embodiments, the dimensions of the different slot couplers in block 35100 are designed such that only the first end of the first slot coupler could engage with the first end of the second slot coupler, and such that only the second end of the first slot coupler could engage with the second end of the second slot coupler. In one such embodiment, the first ends of the first and second slot couplers are narrower than the second ends of the first and second slot couplers. For example, as illustrated in FIG. 4 for slot coupler 1110 of mechanism 1000, end 1114 is narrower than end 1113. Similarly, as illustrated in FIG. 9 for slot coupler 1210 of mechanism 1000, end 1214 is complementary with end 1114 (FIG. 4), incompatible with end 1113 (FIG. 4), and narrower than end 1213. In this embodiment, end 1213 is complementary instead with end 1113 (FIG. 4) and incompatible with end 1114 (FIG. 4).

Block 35200 of method 35000 involves coupling a cap around the golf club shaft to the hosel. In one embodiment, the cap can be similar to cap 1300 of FIGS. 10-13, as used, for example, by mechanism 1000 or any other mechanism described above. In one example, block 35200 can be carried out as illustrated for mechanism 1000 in FIG. 1, coupling cap 1300 around golf club shaft 1400 to hosel 1510, after the slot couplers 1110 and 1210 are aligned as described, for example, in block 35100. After being coupled to the hosel, the cap inhibits the different parts of golf club attachment mechanism from becoming disengaged.

Block 35300 of method 35000 involves pushing the shaft adapter against the hosel adapter. In one example, pushing the shaft adapter against the hosel adapter allows the slot couplers, once aligned per block 35100, to engage such that they cannot rotate relative to each other. In the same or a different example, the cap of block 35200 pushes the shaft, adapter against the hosel adapter, as required by block 35300, while the cap is coupled to the hosel per block 35200.

In one embodiment, blocks 34100, 34200, 34300 and 34400 of method 34000 can be subparts of a single step, and/or their sequence can be otherwise changed. Similarly, in the same or a different embodiment, blocks 35100, 35200, and 35300 of method 35000 can be parts of a single step, and/or their sequence can be otherwise changed. In addition, method 35000 can be a subpart of method 34000. Also, methods 34000 and 35000 can be used for hosel-less golf club heads.

Figure 36:
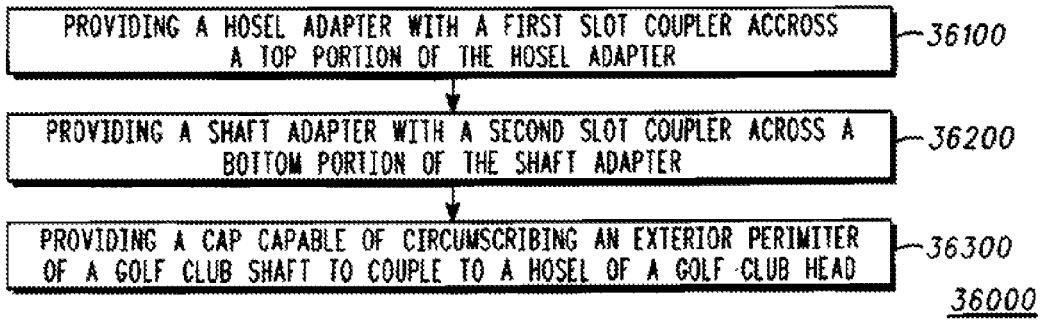
FIG. 36 illustrates a flowchart of method for manufacturing a golf club attachment mechanism, according to a further embodiment.

Continuing with the figures, FIG. 36 illustrates a flowchart of method 36000 for manufacturing a golf club attachment mechanism. As an example, the golf club attachment mechanism in method 36000 can be mechanism 1000 in FIG. 1, mechanism 1400 in FIG. 14, mechanism 2300 in FIG. 23, and mechanism 27000 in FIG. 27.

For method 36000, manufacturing the golf club attachment mechanism can comprise making the golf club attachment mechanism available to purchasers or users, for example, by the manufacturer of the golf club, distributors, marketers, or resellers. The golf club attachment mechanism can be made available via wholesale distribution methods, and/or through retail networks that cater to midstream parties or end users.

Block 36100 of method 36000 involves providing a hosel adapter with a first slot coupler across a top portion of the hosel adapter. As an example, the hosel adapter can be hosel adapter 1100 of mechanism 1000 as shown in FIGS. 1-5, or a similar hosel adapter from any of the mechanisms described above. In one embodiment, the first slot coupler can comprise a slot or a trench. In the same or a different embodiment, the first slot coupler can comprise a tab or a provision. In the same or a different embodiment, the first slot coupler can comprise a half-slot or a half-tab as illustrated for mechanism 27000 in FIG. 27.

In one example, block 36100 of method 36000 can comprise coupling the hosel adapter with a hosel of a golf club head. Such coupling can be accomplished, for example, as described for hosel adapter 1100 in FIG. 1, using epoxy or other suitable adhesives to adhere the hosel adapter to the bottom of the hosel. In some embodiments, the adhesion of the hosel adapter to the hosel via the adhesive can be enhanced by providing grooves at the perimeter of the hosel adapter, such as grooves 1130 and 1140 of hosel adapter 1100 in FIGS. 1-3.

In the same or a different, example, block 36100 of method 36000 can comprise manufacturing the first slot coupler to taper from a first end to a second end narrower than the first end of the first slot coupler. As an example, the first end of the first slot coupler can be end 1114, and the second end of the first slot coupler can be end 1113, as illustrated for hosel adapter 1100 of mechanism 1000 in FIG. 4.

Block 36200 of method 36000 involves providing a shaft adapter with a second slot coupler complementary to the first slot coupler across a bottom portion of the shaft adapter. As an example, the shaft adapter can be shaft adapter 1200 of mechanism 1000 as shown in FIGS. 1 and 6-9, or a similar shaft adapter from any of the mechanisms described above. In one embodiment, the second slot coupler can comprise a slot or a trench. In the same or a different embodiment, the second slot coupler can comprise a tab or a protrusion. In the same or a different embodiment, the second slot coupler can comprise a half-slot or a half-tab as illustrated for mechanism 27000 in FIG. 27.

In one example, block 36200 of method 36000 can comprise coupling the shaft adapter with an end of a golf club shaft. Such coupling can be accomplished, for example, as described for shaft adapter 1200 in FIG. 1. In one embodiment, the shaft adapter can comprise a bore to couple around an exterior perimeter of the end of the golf club shaft. In a different embodiment, the shaft adapter can comprise a rod to couple within an interior perimeter of the end of the golf club shaft. The coupling can be secured using adhesives like epoxy, or other mechanical fasteners such as screws.

In the same or a different example, block 36200 of method 36000 can comprise manufacturing the second slot coupler to taper from a first end to a second end narrower than the first end of the second slot coupler and complementary to the first slot coupler. As an example, the first end of the second slot coupler can be end 1214, and the second end of the second slot coupler can be end 1213, as illustrated for shaft adapter 12000 of mechanism 1000 in FIG. 9.

As illustrated, for example, in. FIGS. 24-26 for mechanisms 1000, 14000, and 23000, respectively, the first and second slot couplers 1110 and 1210 couple together to inhibit a rotational movement of the hosel adapter of block 36100 relative to the shaft adapter of block 36200. In the same or a different embodiment, when coupled together, the first and second slot couplers maintain an alignment of the golf club shaft and the golf club head relative to each other. This alignment may be predetermined or pre-designed. For example, the golf club shaft can be manufactured or designed to limit flexing to be along a flex plane relative to a swing path of the golf club shaft, or at one or more regions of the golf club shaft. In such cases, the first and second slot couplers can be attached and oriented relative to the golf club head and golf club shaft, respectively, keeping the flex plane and/or regions of the golf club shaft in mind. When the first and second slot couplers are coupled together, the golf club head will be automatically aligned relative to the golf club shaft such that the golf club shaft will be able to flex substantially along the predetermined flex plane when swung to strike the golf ball.

Block 36300 of method 36000 involves providing a cap capable of circumscribing an exterior perimeter of a golf club shaft to couple to a hosel of a golf club head. As an example, the cap of block 36300 can be cap 1300, as illustrated in FIGS. 10-13, used by mechanism 1000 in FIGS. 1 and 24, or by other similar mechanisms described above. In one example, the cap can couple to the hosel via complementary screw threads on both the cap and the top of the hosel.

When coupled to the hosel, the cap maintains the shaft adapter of block 36200 in a position within the hosel of the golf club head while pushing the shaft adapter against the hosel adapter of block 36200. In the same or a different example, the cap comprises a flange to push the shaft adapter, or the cap can push the shaft adapter with a bottom of the cap. The cap can thus secure the coupling between the first and second slot couplers of blocks 36100 and 36200, respectively, as illustrated, for example, in FIGS. 24-26 for the different mechanisms described above. This prevents the golf club attachment mechanism from becoming disengaged.

In one embodiment, blocks 36100, 36200, and 36300 of method 36000 can be subparts of a single step. In the same or a different embodiment the sequence of blocks 36100, 36200, and 36300 of method 36000 can be otherwise changed. Also, method 36000 can be used for hosel-less golf club heads.

Although the golf club attachment mechanism and related methods have been described with reference to specific embodiments, various changes may be made without departing from the spirit or scope of the golf club attachment mechanism and related methods. Various examples of such changes have been given in the foregoing description. Accordingly, the disclosure of embodiments of the golf club attachment mechanism and related methods is intended to be illustrative of the scope of the application and is not intended to be limiting. It is intended that the scope of this application shall be limited only to the extent required by the appended claims. For example, it will be readily apparent that, the golf club attachment mechanism and related methods discussed herein may be implemented in a variety of embodiments, and that the foregoing discussion of certain of these embodiments does not necessarily represent a complete description of all possible embodiments. Therefore, the detailed description of the drawings, and the drawings themselves, disclose at least one preferred embodiment of the golf club attachment mechanism and related methods, and may disclose alternative embodiments of the golf club attachment mechanism and related methods.

As a specific example, although the figures illustrate slot couplers 1110 and 1210 as slots, tabs, protrusions and/or trenches of a certain complementary shape, such shape is exemplary and docs not limit other embodiments from using other complementary geometries, such as ovals, triangles, pentagons, trapezoids, or the like, capable of providing functionality similar to that described above for slot couplers 1110 and 1210. Therefore, the detailed description of the drawings, and the drawings themselves, disclose at least one preferred embodiment of the golf club attachment mechanism and related methods, and may disclose alternative embodiments of the golf club attachment mechanism and related methods.

In another example, the methods, apparatus, and/or articles of manufacture described herein may not include a separate hosel adapter, or the hosel adapter may be integral to a shaft receiver of the golf club head. In some embodiments, the shaft receiver can be referred to as a hosel. Referring back to FIG. 1, for example, slot coupler 1110 of hosel adapter 1100 may be an integral portion of golf club head 1500. That is, slot coupler 1110 may be formed across an inner bottom surface of a shaft receiver, such as hosel 1510, via a machine (e.g., cut, drilled, etc.). Alternatively, slot coupler 1110 may be cast as a portion of golf club head 1500 across a bottom of the shaft receiver. Accordingly, shaft adapter 1200 may engage directly with golf club head 1500. A similar implementation can be had for a hosel-less golf club head where the shaft receiver comprises a cavity, instead of a hosel, to receive shaft adapter 1200. In such an example, slot coupler 1110 may also be formed across an inner bottom surface of the shaft receiver via a machine or cast as a portion of the hosel-less golf club head. Although certain examples have been described above, other suitable methods may be used to form a slot coupler as an integral portion of a golf club head.

All elements claimed in any particular claim are essential to the golf club attachment mechanism or related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club attachment mechanism comprising:

a hosel adapter configured to be located at a bottom of a hosel of a golf club head, the hosel adapter comprising a first slot coupler across a top portion of the hosel adapter;

a shaft adapter configured to be located at an end of a golf club shaft, the shaft adapter comprising a second slot coupler, complementary to the first slot coupler, across a bottom portion of the shaft adapter; and a cap configured to circumscribe an exterior perimeter of a golf club shaft;

wherein:

the first slot coupler tapers across a top end of the hosel adapter, from a first end to a second end narrower than the first end of the first slot coupler;

the second slot coupler tapers across a bottom end of the shaft adapter, from a first end to a second end narrower than the first end of the second slot coupler, and is complementary to the first slot coupler;

the first slot coupler and the second slot coupler couple together within the hosel, when the shaft adapter is inserted into the hosel along a central-length axis of the hosel, to restrict a rotational movement of the hosel adapter relative to the shaft adapter;

the first slot coupler and the second slot coupler are configured to decouple from each other within the hosel, when the shaft adapter is removed along the central-length axis of the hosel, to permit a separation of the golf club shaft from the golf club head; and the cap is configured to couple to a hosel of a golf club head, at least partially above the shaft adapter, to maintain the shaft adapter in a position within the hosel.

2. The mechanism of claim 1, wherein:

when coupled together, the first slot coupler and the second slot coupler maintain an alignment of the golf club shaft and the golf club head relative to each other.

3. The mechanism of claim 2, wherein:

the hosel adapter tapers complementary to the hosel.

4. The mechanism of claim 2, wherein:

the shaft adapter further comprises a bore to couple around an exterior perimeter of the end of the golf club shaft.

5. The mechanism of claim 2, wherein:

the shaft adapter further comprises a rod to couple within an interior perimeter of the end of the golf club shaft.

6. The mechanism of claim 1, wherein:

the first slot coupler comprises a slot; and the second slot coupler comprises a tab complementary to the slot of the first slot coupler.

7. The mechanism of claim 1, wherein:

the second slot coupler comprises a slot; and the first slot coupler comprises a tab complementary to the slot of the second slot coupler.

8. The mechanism of claim 1, wherein:

the first slot coupler comprises a first slope; and the second slot coupler comprises a second slope complementary to the first slope of the first slot coupler.

9. The mechanism of claim 1, wherein:

the first slot coupler further comprises:

a first surface; and a second surface non-planar with the first surface of the first slot coupler;

the second slot coupler further comprises:

a first surface; and a second surface non-planar with the first surface of the second slot coupler;

the first surface of the first slot coupler engages the first surface of the second slot coupler; and the second surface of the first slot coupler engages the second surface of the second slot coupler.

10. The mechanism of claim 1, wherein:

the hosel adapter further comprises a first groove at a perimeter of the hosel adapter.

11. The mechanism of claim 10, wherein:

the hosel adapter further comprises a second groove substantially perpendicular to the first groove and located at the perimeter of the hosel adapter.

12. The mechanism of claim 10, further comprising:

an adhesive material located in the first groove to secure the hosel adapter to the hosel.

13. The mechanism of claim 1, wherein a body of the hosel adapter tapers complementary to the hosel.

14. The mechanism of claim 1, wherein a body of the shaft adapter tapers complementary to the hosel.

15. The mechanism of claim 1, wherein:

the hosel adapter and the shaft adapter remain entirely within the hosel while the cap couples to the hosel.

16. The mechanism of claim 1, wherein:

the hosel further comprises a hosel fastener at a top portion of the hosel;

the cap further comprises:

a cap flange; and a cap fastener complementary to the hosel fastener; and the cap flange pushes the shaft adapter against the hosel adapter while the cap fastener couples to the hosel fastener.

17. The mechanism of claim 16, wherein:

the cap flange comprises at least one of:

an interior flange at an inner perimeter of the cap; or a bottom of the cap.

18. The mechanism of claim 16, wherein:

the cap fastener and the hosel fastener comprise complementary screw threads.

19. The mechanism of claim 1, wherein:

the hosel adapter is integral with the bottom of the hosel;

the first slot coupler is located across the bottom of the hosel; and when coupled together, the first slot coupler and the second slot coupler maintain an alignment of the golf club shaft and the golf club head relative to each other.

20. A mechanism for coupling together a golf club head and a golf club shaft, the mechanism comprising:

a shaft receiver plug with a trench at a top end of the shaft receiver plug;

a shaft sleeve with a protrusion at a bottom end of the shaft sleeve; and a nut configured to couple at least partially above the shaft sleeve at an exterior perimeter of the golf club shaft;

wherein:

the shaft receiver plug is configured to couple at a bottom of a shaft receiver of the golf club head;

the shaft sleeve comprises a bore to couple to an exterior perimeter of an end of the golf club shaft;

the trench comprises a first wall and tapers in width, from a first plug end to a second plug end, across the top end of the shaft receiver plug;

the protrusion comprises a second wall and tapers in width, from a first sleeve end to a second sleeve end, across the bottom end of the shaft sleeve;

the protrusion is complementary to the trench and configured to:

couple inside the trench when the shaft sleeve is inserted into the shaft receiver along a central-length axis of the shaft receiver; and decouple from the trench when the shaft sleeve is removed along the central-length axis of the shaft receiver;

the nut comprises:

a nut flange; and a nut fastener complementary to a shaft receiver fastener at a top portion of the shaft receiver;

when the nut fastener and the shaft receiver fastener couple together, the nut flange pushes the shaft sleeve against the shaft receiver plug to maintain the protrusion within the trench; and when the trench and the protrusion couple together, the first wall interacts with the second wall to predetermine an orientation of the golf club shaft relative to the golf club head.

21. The mechanism of claim 20, wherein:

the trench comprises a first slope; and the protrusion comprises a second slope complementary to the first slope of the trench.

22. The mechanism of claim 20, wherein:

the trench comprises a first varying width; and the protrusion comprises a second varying width complementary to the first varying width.

23. The mechanism of claim 20, wherein:

the shaft receiver plug further comprises at least one of:

a substantially horizontal groove circumscribing a perimeter of the shaft receiver plug; and a substantially vertical groove at the perimeter of the shaft receiver plug.

24. The mechanism of claim 20, wherein:

an adhesive material secures the shaft receiver plug to a bottom portion of the shaft receiver.

25. The mechanism of claim 20, wherein:

the shaft receiver plug tapers complementary to an inner perimeter of the shaft receiver.

26. The mechanism of claim 20, wherein:

the shaft sleeve tapers complementary to an inner perimeter of the shaft receiver.

27. The mechanism of claim 20, wherein:

the protrusion comprises at least one of:

an oval-shaped protrusion;

a triangle-shaped protrusion;

a pentagon-shaped protrusion; or a trapezoid-shaped protrusion.

* * * * *